US009453337B2

(12) United States Patent
Fritz et al.

(10) Patent No.: US 9,453,337 B2
(45) Date of Patent: Sep. 27, 2016

(54) WALL-PANEL SYSTEM FOR FAÇADE MATERIALS

(71) Applicant: Evolve Manufacturing, LLC, Winchester, VA (US)

(72) Inventors: Gregory Fritz, Winchester, VA (US); George Fritz, Harwood, MD (US); Joseph Bohm, Chesapeake Beach, MD (US)

(73) Assignee: EVOLVE MANUFACTURING, LLC, Winchester, VA (US)

( * ) Notice: Subject to any disclaimer, the term of this patent is extended or adjusted under 35 U.S.C. 154(b) by 0 days.

(21) Appl. No.: 14/873,153

(22) Filed: Oct. 1, 2015

(65) Prior Publication Data

US 2016/0215497 A1 Jul. 28, 2016

Related U.S. Application Data

(63) Continuation of application No. 14/321,489, filed on Jul. 1, 2014, now Pat. No. 9,151,043.

(51) Int. Cl.

| | |
|---|---|
| ***E04B 2/92*** | (2006.01) |
| ***E04B 2/44*** | (2006.01) |
| ***E04B 1/70*** | (2006.01) |
| ***E04B 2/42*** | (2006.01) |
| ***E04C 2/52*** | (2006.01) |
| ***E04B 2/56*** | (2006.01) |
| ***E04B 2/28*** | (2006.01) |

(52) U.S. Cl.

CPC ..... *E04B 2/92* (2013.01); *E04B 1/7038* (2013.01); *E04B 2/42* (2013.01); *E04B 2/44* (2013.01); *E04C 2/52* (2013.01); *E04B 2002/565* (2013.01)

(58) Field of Classification Search

CPC ..... E04B 1/70; E04B 2/707; E04B 2/28; E04F 13/047; E04F 13/04; E04C 2/52

USPC ..... 52/302.1, 302.3, 309.1, 309.3, 309.13, 52/408, 411, 506.01, 515, 630, 741.3

See application file for complete search history.

(56) References Cited

U.S. PATENT DOCUMENTS

| | | | | | |
|---|---|---|---|---|---|
| 3,435,577 | A * | 4/1969 | O'Leary | E04F 13/147 | 156/71 |
| 4,181,450 | A * | 1/1980 | Rasen | E02B 3/043 | 405/19 |
| 4,680,907 | A * | 7/1987 | Williams | E04B 1/642 | 4/614 |
| 4,920,716 | A * | 5/1990 | Coffey | E04F 13/04 | 52/386 |
| 5,099,627 | A * | 3/1992 | Coulton | E04D 13/17 | 52/408 |
| 5,232,759 | A * | 8/1993 | Golze | E02B 3/125 | 112/410 |
| 5,287,673 | A * | 2/1994 | Kreikemeier | E04F 13/04 | 52/663 |
| 5,429,453 | A * | 7/1995 | Stroud | E01C 13/065 | 405/229 |
| 5,481,843 | A * | 1/1996 | Kreikemeier | E04F 13/04 | 52/663 |
| 5,552,207 | A * | 9/1996 | Porter | D03D 9/00 | 428/109 |
| 5,651,641 | A * | 7/1997 | Stephens | D04H 11/00 | 405/15 |

(Continued)

*Primary Examiner* — Rodney Mintz

(74) *Attorney, Agent, or Firm* — Axenfeld Law Group, LLC; Robert R. Axenfeld

(57) ABSTRACT

A wall system for improved water drainage, and diminished probability of occurrence of mold, mildew and rot formation behind cladding attached to the wall system. The wall system is generally material agnostic, and may be used as an interface between a structural-wall sheathing (including house wraps, gage-metal framing, and felt), and exterior-façade materials, including, but not necessarily limited to: faux masonry, faux stone, mortar, stucco, and other aesthetic or exterior-façade materials. The following disclosure is also directed to systems and methods of attaching faux stone to a wall.

12 Claims, 23 Drawing Sheets

(56) References Cited

U.S. PATENT DOCUMENTS 5,729,936 A * 3/1998 Maxwell ..... E04C 2/521 52/220.2
5,891,549 A * 4/1999 Beretta ..... B29D 28/00 24/452
5,979,133 A * 11/1999 Funkhouser ..... E04D 5/10 428/353
6,069,098 A * 5/2000 Shimizu ..... B32B 7/02 428/912
6,131,353 A * 10/2000 Egan ..... B32B 5/02 52/309.1
6,171,984 B1 * 1/2001 Paulson ..... D03D 13/006 405/107
6,233,890 B1 * 5/2001 Tonyan ..... E04B 1/70 52/302.1
6,296,912 B1 * 10/2001 Zickell ..... B32B 11/00 428/141
6,550,212 B2 * 4/2003 Lubker, II ..... B32B 5/12 52/302.1
6,594,965 B2 * 7/2003 Coulton ..... E04B 1/7046 52/302.1
6,761,006 B2 * 7/2004 Lubker, II ..... B32B 5/12 52/302.1
6,786,013 B2 * 9/2004 Coulton ..... B32B 3/28 405/45
6,804,922 B1 * 10/2004 Egan ..... B32B 5/02 52/309.1
6,857,818 B2 * 2/2005 Bussey, Jr. ..... E02B 11/005 405/36
6,869,901 B2 * 3/2005 Lubker, II ..... B32B 5/12 442/208
7,001,111 B2 * 2/2006 Maxwell ..... E02D 17/20 405/15
7,096,630 B1 * 8/2006 Keene ..... E04F 15/20 52/302.1
7,166,365 B2 * 1/2007 Bramlett ..... B32B 7/12 428/489
7,198,833 B1 * 4/2007 West ..... B44F 9/04 264/245
7,520,097 B2 * 4/2009 Aalbers ..... B32B 27/12 52/302.1
7,607,270 B2 * 10/2009 Ehrman ..... E04B 1/625 428/297.4
7,730,685 B1 * 6/2010 Keene ..... E04B 1/7046 52/169.5
7,757,447 B2 * 7/2010 Aalbers ..... B32B 27/12 52/302.1
7,858,174 B2 * 12/2010 Ehrman ..... E04B 1/625 156/178
7,959,991 B1 * 6/2011 West ..... B44F 9/04 428/15
8,245,472 B2 * 8/2012 Keene ..... E04F 13/04 52/344
8,440,289 B2 * 5/2013 De Giuseppe ..... B32B 3/30 428/156
8,596,004 B2 * 12/2013 Coulton ..... E04B 1/625 52/409
8,647,734 B2 * 2/2014 Keene ..... B32B 3/06 428/193
8,733,047 B1 * 5/2014 Hanson ..... E04B 2/845 52/348
8,733,048 B1 * 5/2014 Hanson ..... E04B 1/18 52/348
8,734,932 B2 * 5/2014 Keene ..... B32B 5/26 181/288
8,828,162 B2 * 9/2014 Peyras-Carratte ..... A47L 13/16 156/62.2
8,904,724 B1 * 12/2014 Hanson ..... E04B 2/845 52/348
9,151,043 B1 * 10/2015 Fritz ..... E04B 2/28 52/302.1
9,259,083 B1 * 2/2016 Fritz ..... A47B 96/18 29/428
2001/0047631 A1 * 12/2001 Nolan ..... E01F 8/0023 52/378
2001/0054263 A1 * 12/2001 Coulton ..... B32B 3/28 52/199
2002/0108333 A1 * 8/2002 Clayton ..... E04B 1/70 52/302.1
2002/0182963 A1 * 12/2002 Bramlett ..... B32B 7/12 442/386
2003/0037499 A1 * 2/2003 Coulton ..... E04B 1/7046 52/302.3
2004/0025465 A1 * 2/2004 Aldea ..... E04G 23/0218 52/514
2004/0142618 A1 * 7/2004 Porter ..... B28B 19/0092 442/266
2004/0157055 A1 * 8/2004 Bramlett ..... B32B 7/12 428/343
2005/0055983 A1 * 3/2005 Tomes ..... E04B 1/70 52/782.1
2005/0144901 A1 * 7/2005 Egan ..... D03D 1/00 52/782.1
2006/0065342 A1 * 3/2006 Porter ..... B28B 19/0092 156/42
2006/0101758 A1 * 5/2006 Egan ..... E04F 13/0885 52/408
2006/0105653 A1 * 5/2006 Porter ..... B28B 19/0092 442/79
2006/0277854 A1 * 12/2006 Egan ..... E04B 1/70 52/302.3
2007/0261365 A1 * 11/2007 Keene ..... E04F 13/04 52/796.1
2008/0041005 A1 * 2/2008 Ehrman ..... E04B 1/625 52/408
2009/0173020 A1 * 7/2009 Aalbers ..... B32B 27/12 52/198
2009/0193738 A1 * 8/2009 Kortuem ..... E02D 31/02 52/302.1
2009/0239430 A1 * 9/2009 Egan ..... D03D 1/00 442/46
2009/0274518 A1 * 11/2009 Iske ..... E02D 19/18 405/43
2009/0282762 A1 * 11/2009 Iske ..... E02D 31/02 52/302.1
2009/0320399 A1 * 12/2009 Ehrman ..... E04B 1/625 52/309.13
2010/0269439 A1 * 10/2010 Morrisette ..... E04B 1/08 52/309.4
2011/0143616 A1 * 6/2011 Egan ..... D03D 1/00 442/20
2011/0173909 A1 * 7/2011 Viau ..... B44C 5/0415 52/302.1
2011/0256786 A1 * 10/2011 Bomberg ..... E04B 1/625 442/1
2012/0216481 A1 * 8/2012 Hunt-Hansen ..... E04F 13/04 52/741.3
2012/0231692 A1 * 9/2012 Peyras-Carratte ..... A47L 13/16 442/411
2012/0238163 A1 * 9/2012 Scherer ..... D03D 9/00 442/3
2012/0247040 A1 * 10/2012 Buoni ..... E04B 1/70 52/302.1
2012/0304565 A1 * 12/2012 Hines ..... E04F 13/04 52/302.1
2012/0317914 A1 * 12/2012 Bomberg ..... B32B 37/02 52/443
2013/0139457 A1 * 6/2013 Coulton ..... B32B 7/14 52/309.1
2013/0180203 A1 * 7/2013 Xiangli ..... E04B 1/62 52/741.3
2013/0276392 A1 * 10/2013 Johnson ..... E04F 13/04 52/302.1
2014/0170916 A1 * 6/2014 Krasnoff ..... E04C 5/07 442/58
2015/0096247 A1 * 4/2015 Foster ..... E04F 13/04 52/302.3

* cited by examiner

WALL-PANEL SYSTEM FOR FAÇADE MATERIALS

REFERENCE TO NON-PROVISIONAL PRIOR APPLICATION

This application is a continuation of prior U.S. application Ser. No. 14/321,489 filed Jul. 1, 2015, which is fully incorporated by reference.

TECHNICAL FIELD

The following disclosure is directed to a wall system for receiving cladding. The wall system offers improved water drainage, and diminished probability of occurrence of mold, mildew and rot formation behind the cladding. The wall system is also inexpensive, and simple to install and use. In addition, the wall system is generally material agnostic, and may be used as an interface between a structural wall (including sheathing, house wraps, gauge-metal framing, and felt), and exterior-façade materials, including, but not necessarily limited to: faux masonry, faux stone, stone, brick, mortar, stucco, and other aesthetic or exterior-façade materials.

The following disclosure is also directed to systems and methods of attaching faux or natural stone, and other artificial or natural aesthetic-façade materials to a wall.

BACKGROUND

Most building codes in the United States require that a water-resistive barrier or non-water-absorbing layer or designed-drainage space be installed before application of a hard-coat stucco or faux stone or other veneer.

Nevertheless, many veneers adhered to the exterior wall (i.e., sheathing, house wraps, metal framing, and felt) still trap moisture behind the veneer. This can lead to damage and rot to the interior structure of a building, and mold issues. In addition, many of these systems often attract wood-destroying insects such as termites, and carpenter ants.

In particular, the advent of faux-stone veneer in recent years, has led to the finding that many of these wall systems were either improperly installed, or had improper water drainage or vapor-permeable barriers between the faux stone, and sheathing or housing wraps.

Consequently, many houses and buildings that use or used faux stone, will experience moisture and insect problems that result in 100% removal of the faux stone, and major structural repairs.

On the other hand, the advantage of not requiring a stone mason to install stone veneer to the side of a building is appealing to the construction industry. Further, because faux stone does not require mortar for their attachment means to a wall, there are less weather and seasonal restrictions to installations. So, faux-stone veneer is desirable to the consumer and building industry, because it is generally less expensive and quicker to install than natural stone. But attaching simulated stone to the sides of walls requires careful attention to water and mold, and requires expertise.

Thus, there remains a need for a simplified wall system for attaching cladding of all types, including faux stone. Such a wall system should offer water drainage, and diminished probability of occurrence of mold, mildew and rot formation behind the cladding.

In addition, there is a need for simplified method and system of attaching individual faux stones to a wall, requiring less time, expertise, and material to install.

SUMMARY

The following disclosure is directed to a wall system for receiving cladding. The wall system offers improved water drainage, and diminished probability of occurrence of mold, mildew and rot formation behind the cladding. The wall system is also inexpensive, and simple to install and use. In addition, the wall system is generally material agnostic, and may be used as an interface between a structural-wall sheathing (including house wraps, gage-metal framing, and felt), and exterior-façade materials, including, but not necessarily limited to: faux masonry, faux stone, mortar, stucco, and other aesthetic or exterior-façade materials.

In one aspect, wall system includes a structural-separation-plane panel, a matrix, and a plurality of spacers. The panel is generally planar, and includes a back surface, and front surface. The front surface may be substantially flat and planar. Alternatively, the front surface may include one or more patterns and shapes.

In one aspect, matrix is a nylon mesh. That is, the matrix includes a mesh of interwoven-nylon strands. The matrix is embedded into the front surface of the panel when the panel is in a liquefied state (such as a mold). But as appreciated by those skilled in the art having the benefit of this disclosure, the matrix may be coupled to the panel by other means such as glue, staples, tacks, or other coupling means. As a whole, the matrix is permeable to both air and water.

The spacers are bumps that protrude from the back surface of the panel. That is, the spacers extend from the back surface of the panel, and form channels for drainage of water when the panel is secured to the wall. That is, spacers are sandwiched between the back surface, and an exterior-most portion of the wall of a building, thereby forming channels for drainage of water. The channels provide open drainage space for water, and do not catch or contain water.

The spacers may include different shapes, and dimensions. In one example, each spacer is approximately ⅛ of an inch thick measured from the back surface of the separation panel extending to a back surface of each spacer. Further, each spacer is molded into, or a part of the back surface of the panel.

Various other examples of wall systems (and constituent parts, shapes, and sizes) for attaching materials are described in the Detailed Description below, and are illustrated in the drawings.

The following disclosure is also directed to systems and methods of attaching faux stone and natural or other man-made materials to a wall.

This summary is provided to introduce a selection of concepts in a simplified form that are further described below. This summary is not necessarily intended to identify key features or essential features of the claimed subject matter, nor is it necessarily intended to be used as an aid in determining the scope of the claimed subject matter.

Reference herein to "example," "embodiments" or similar formulations means that a particular feature, structure, operation or characteristic described in connection with the example, is included in at least one implementation in this description. Thus, the appearance of such phrases or formulations herein are not necessarily all referring to the same example. Further, various particular features, structures, operations, or characteristics may be combined in any suitable manner in or more examples.

BRIEF DESCRIPTION OF THE DRAWINGS

The detailed description is described with reference to the accompanying figures. In the figures, the left-most digit(s) of a reference number identifies the figure in which the reference number first appears. The figures are not necessarily drawn to scale.

DETAILED DESCRIPTION

Figure 1:
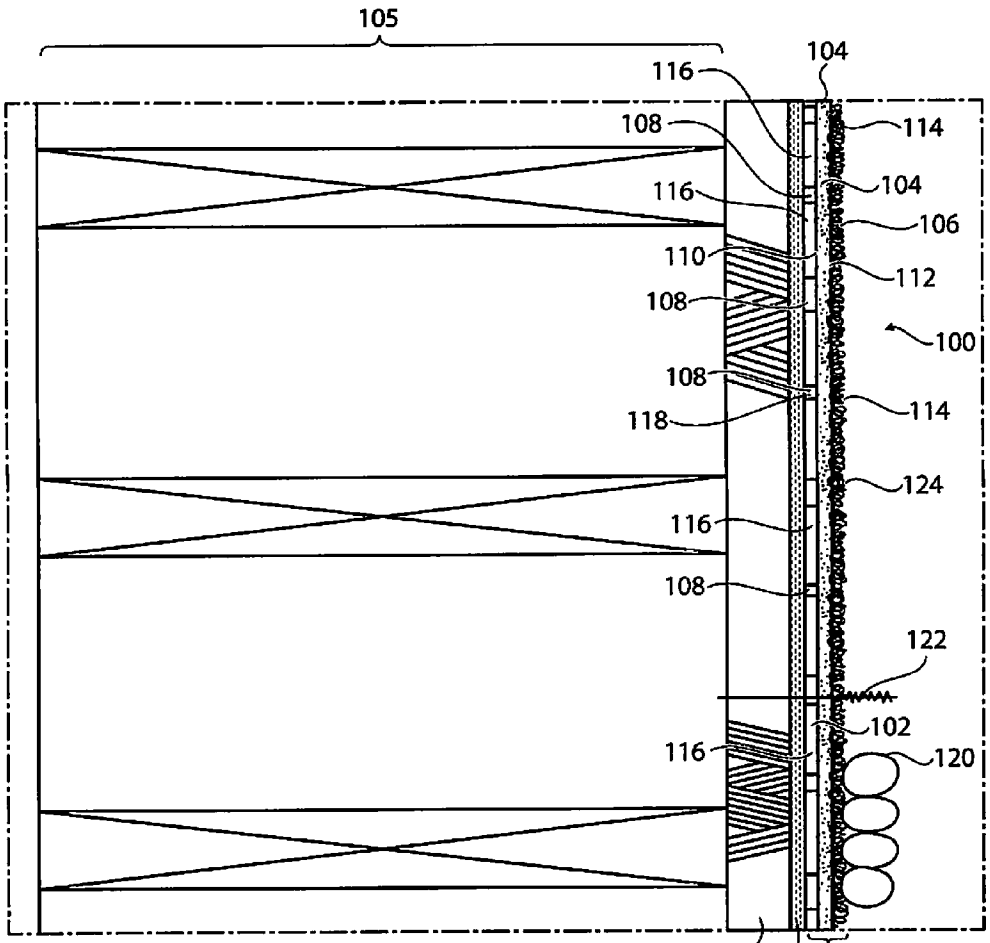
FIG. 1 is a profile view of a wall-panel system for attachment to a wall of a building in accordance with this disclosure.

FIG. 1 is a profile view of a wall-panel system 100 for attachment to a wall 102 of a building. System 100 includes a structural-separation-plane panel 104, a matrix 106, and a plurality of spacers 108. As depicted in FIG. 1, wall 102 is typically a non-aesthetic-structural portion of a building, such as a house. In one example, wall 102 is plywood commonly used in home construction. However, wall 102 may be made of any suitable material used in the building industry. In addition, on an attached to wall 102 from the interior is any suitable support system 105 for supporting wall 102 in a vertical position. On the exterior portion of wall 102 is typically an outer material 101 such as sheathing, house wrap, felt or other suitable materials. These materials are not required, but are typically used in the building industry for variety of reasons, including meeting code requirements.

Panel 104 is generally planar, and includes a back surface 110, and front surface 112. In one example, panel 104 is fiberglass. However, as will be appreciated by those skilled in the art, after having the benefit of this disclosure, panel 104 may be constructed of other light-weight materials such as polymeric materials, as will be discussed in other examples below.

In one example, panel 104 is approximately 1/16 of an inch thick measured from back surface 110 to front surface 112, but as will be apparent to those skilled in the art having the benefit of this disclosure, panel 104 may be other suitable thicknesses greater or smaller than 1/16 of an inch, such as, but not necessarily limited to: 1, 3/32, 1/4 or 1/8 of an inch thick. Front surface 112 is may be substantially flat and planar. Alternatively, as will be described below, front surface 112 may include one or more patterns and shapes.

In one example, matrix 106 is a nylon mesh. That is, matrix 106 includes a mesh of interwoven-nylon strands 114. However, matrix 106 may include other suitable waterproof materials, such as but not limited to plastic, polyethylene, or polyester. In one example, matrix 106 is about 3/16 inch to 1/4 inch thick, but may include other suitable thickness (greater or less than the aforementioned thicknesses).

In one aspect, matrix 106 is the nylon mesh portion of drainage mats, such as Driwall™ Rainscreen 075-1 mats from Keene company, Mayfiled Heights, Ohio, USA. Alternatively, mesh may also include fused and entangled filaments manufactured by Enka, or Benjamin Obdyke and others.

Matrix 106 is fastened to front surface 112 of panel 104. In one example, matrix 106 is embedded into front surface 112 of panel 104, when panel 104 is formed. But as appreciated by those skilled in the art having the benefit of this disclosure, matrix 106 may be coupled to panel 104 by mechanical means such as glue, staples, tacks, or other coupling means. As a whole, matrix 106 is permeable to both air and water.

Figure 2:
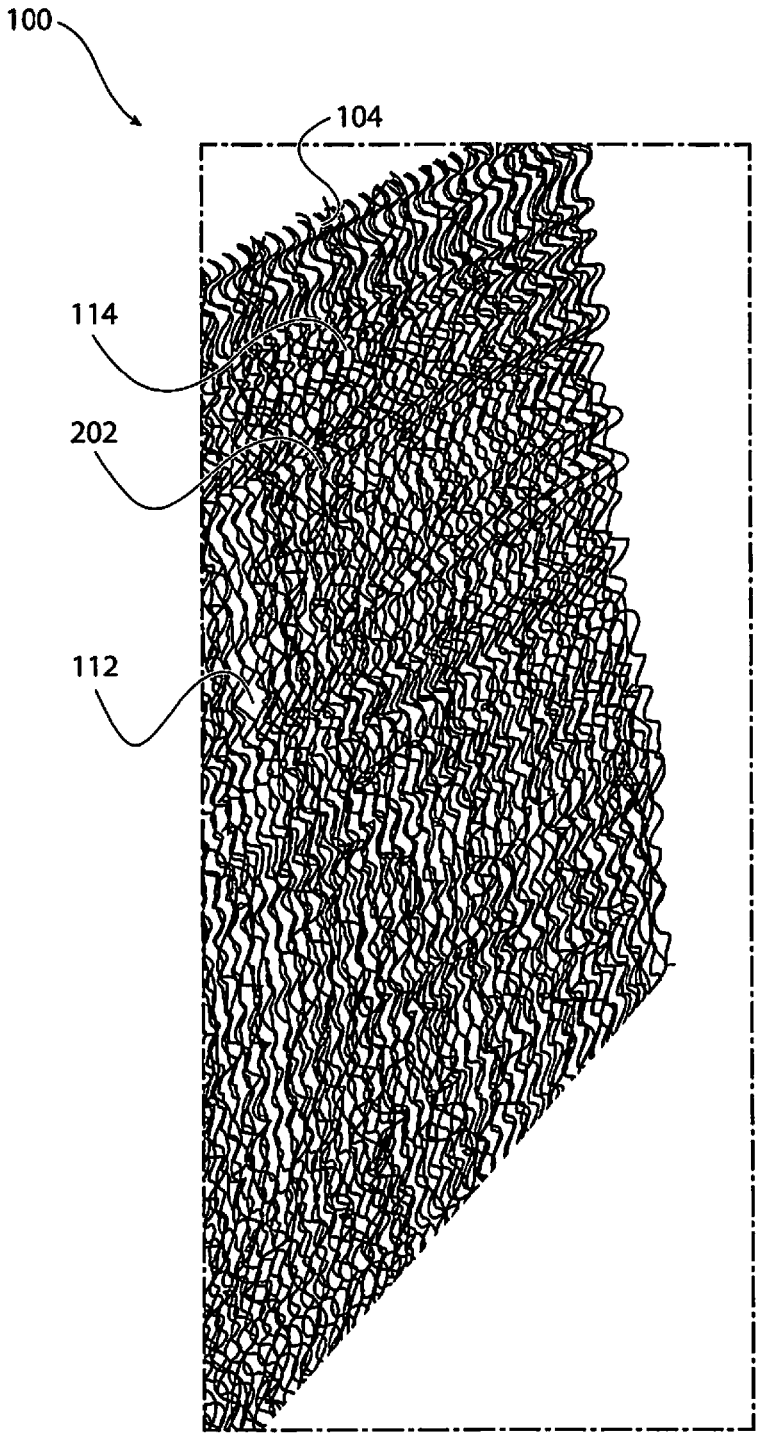
FIG. 2 shows a perspective-front view of the system of FIG. 1, and specifically a front face of a panel of the system in accordance with this disclosure.

FIG. 2 shows a perspective-front view of system 100, and specifically a front face of panel 104. As depicted in FIG. 2, there are gaps 202 between strands 114 comprising matrix 106, thereby revealing front surface 112 of panel 104. Thus, although strands 114 are generally not permeable to water or air, matrix 106 as a whole is a breathable and vapor-permeable layer. Cladding such as faux stone (not shown in FIG. 2) may attached directly to panel 104 with matrix 106 serving as breathable membrane sandwiched between panel 104 and cladding.

Referring back to FIG. 1, spacers 108 are bumps that protrude from back surface 110 of panel 104. That is, spacers 108 extend from back surface 110 of panel 104, and form channels 116 for drainage of water when panel 104 is secured to wall 102. That is, spacers 108 are sandwiched between the back surface 110 and an exterior-most portion of wall 102 of a building, thereby forming channels 116.

Spacers 108 may include different shapes, and dimensions. For instance, in one example, each spacer 108 is approximately ⅛ of an inch thick measured from back surface 110 of panel 104 to a back surface 118 of each spacer 108. Further, each spacer 108 is simply molded into back surface 110 of panel 104. That is, each spacer 108 is formed when molding panel 104. Alternatively, one or more spacers 108 may be attached to panel 104, and may not necessarily be an integral part of panel 104. For instance, it may be desirable to attach spacers after the panel 104 is formed from a molding process (if a molding process is used).

Figure 3A:
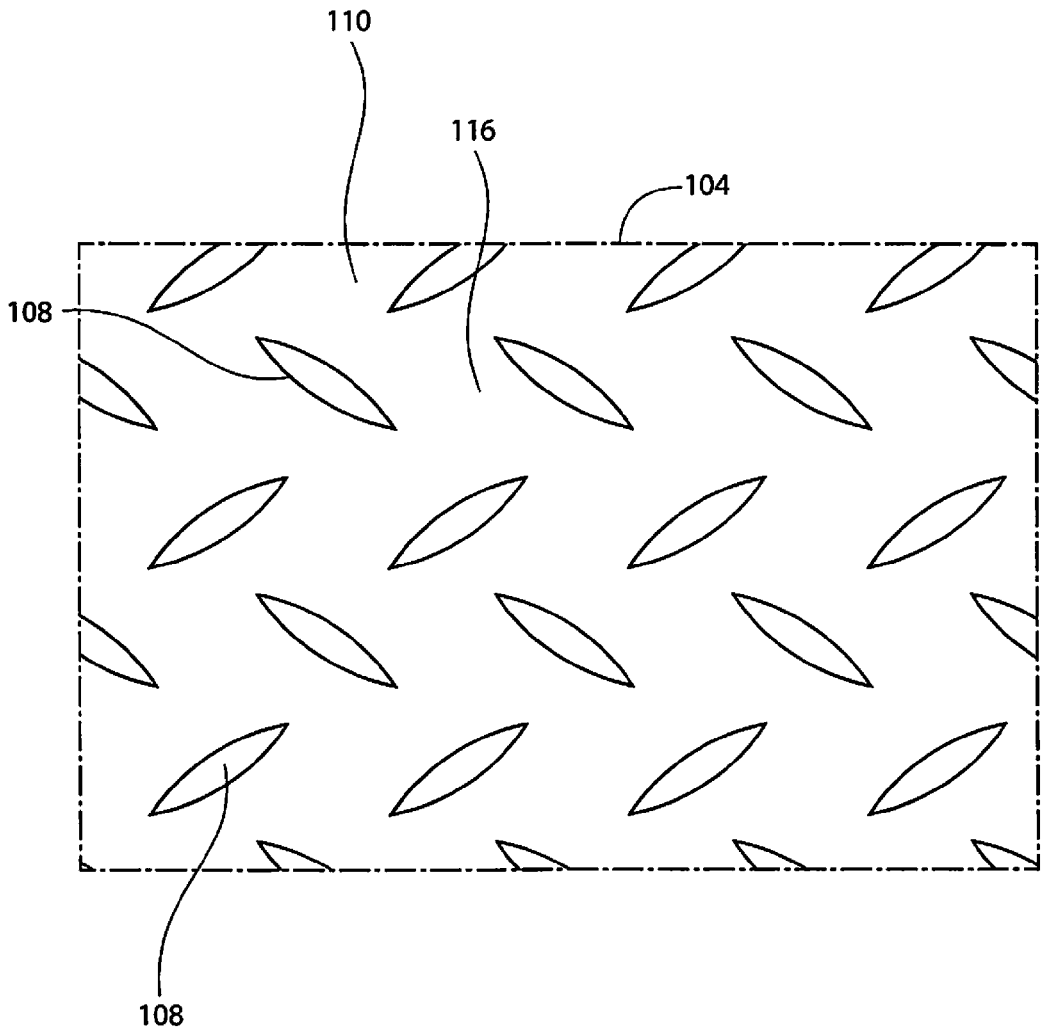
FIG. 3A shows a top view a back side of a panel, and an example shape for each spacer in accordance with this disclosure.

FIG. 3A shows a top view a backside of panel 104. In particular, FIG. 3A depicts one example shape for each spacer 108. That is, each spacer 108 in FIG. 3A is an oblong-oval-shaped bump (similar to the shape of almond). Vertical and horizontal spacers 108 crisscross each other at approximately 45 degree angles forming a pattern. As shown, multiple channels 116 are formed so as to permit drainage and evaporation of water between wall 102 and back surface 110 of panel 104. Each spacer 108 is approximately one inch in length, and one-to-two inches apart from each other depending on the orientation of the spacer.

However, each spacer 108 may come be of in different sizes and shapes, and distances apart from each other, so as not to catch or retain water as would be appreciated by those skilled in the art. For instance, spacers 108 may be circular, triangular, square, rectangular, star shaped or other suitable shapes as would be appreciated by those skilled in the art, after having the benefit of this disclosure. The water-drainage cavity (i.e. plane) formed on the backside of the separation panel from spacers—or other means such as mesh—is usually between about ⅛ of an inch and about three inches.

In addition, the ratio between spacers and no spacers may vary. So, the shape, depth and size of each spacer may vary, and ratio of spacers to no spacers may vary. Still further, spacers 108 may not crisscross at an angle. Instead, each spacer may be aligned in rows and columns, with each spacer in alignment with the other.

In addition, channels 116 may be formed by other means, such as by ribs, grooves, or other shaped protrusions formed on either back surface 110 of panel 104 or on a major surface of wall 102 (including sheathing, house wrap, felt, etc.).

Figure 3B:
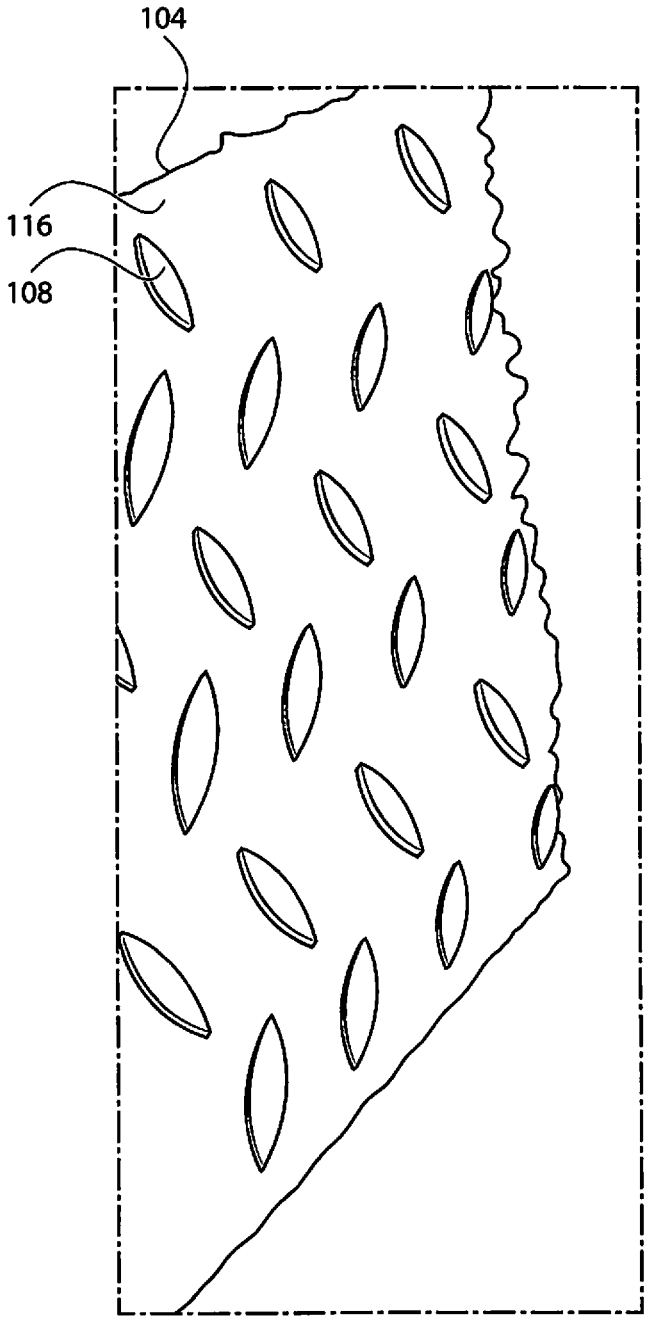
FIG. 3B shows a perspective view of a backside of a panel depicted in FIG. 3A.

FIG. 3B shows a perspective view of a backside 110 of panel 104 with spacers 108 and channels 116.

Referring back to FIG. 1, panel 104 may be installed against outer material 101 of (i.e., sheathing, house wrap, felt, plywood, etc.) wall 102 by any mechanical fastening means accepted in the industry, and in accordance with national and local ordinances.

In one example, a liquid applied waterproofing air barrier or DuPont's Tyvek® felt may be applied to wall 102 before fastening panel 104 to wall 102. Panel 104 may be nailed or screwed into plywood at different intervals. In one example, the fasteners 122 are inserted in the middle of each spacer 108. As would be appreciated by those skilled in the art, fasteners 122 may include nails, screws, staples or other fastening means (such as adhesives in the alternative).

Veneer, such as faux stones 120, may be fastened to a front face 124 of system 100 by structural (such as screws, nails or other fastening means) or chemical means (such as glue, adhesive, or mortar). Front face 124 faces away from wall 102. In addition, stucco (in lieu of veneer), and mortar may be adhered directly to matrix 106.

Figure 4:
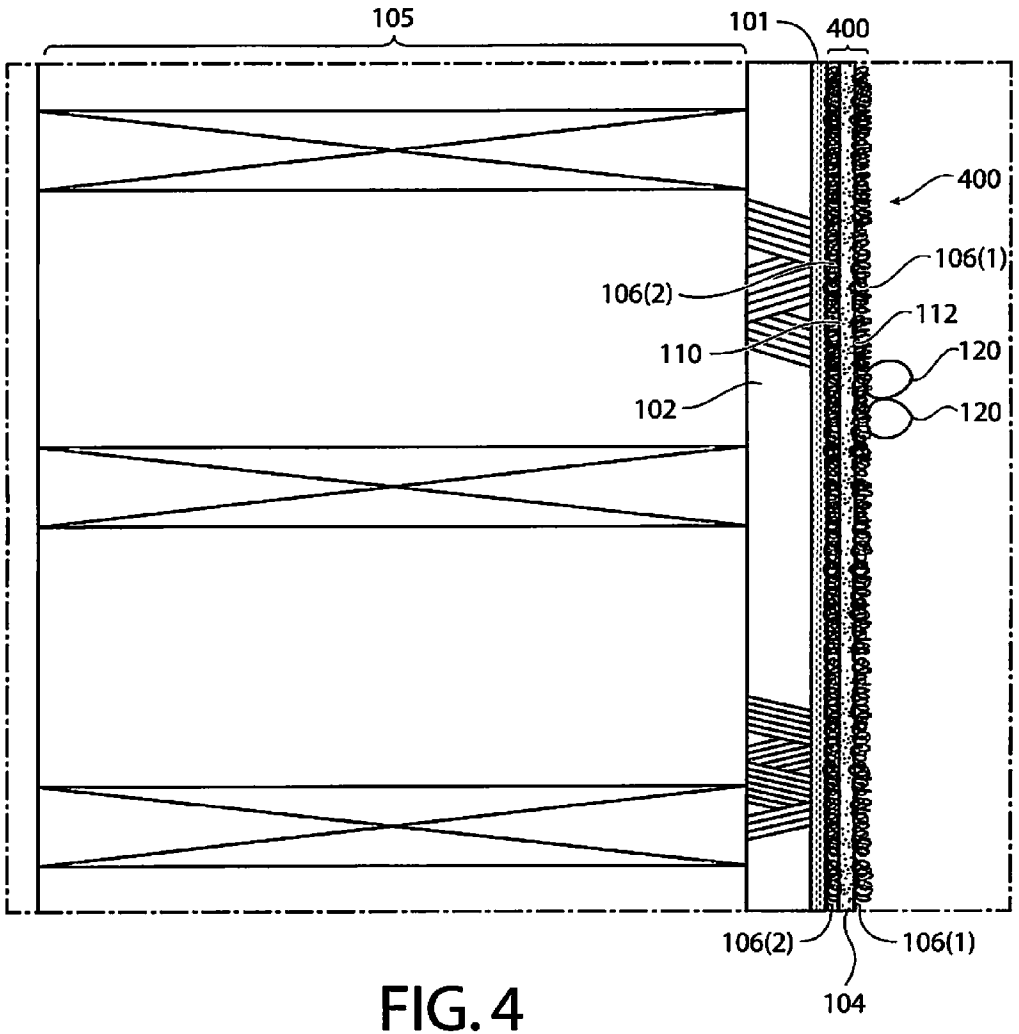
FIG. 4 is a profile view of another example of a wall-panel system for attachment to a wall of a building in accordance with this disclosure.

FIG. 4 is a profile view of another example of a wall-panel system 400 for attachment to a wall 102 of a building. System 400 includes the same panel 104, matrix 106 (shown in FIG. 4 as 106(1)) embedded in front surface 112 of panel 104, as depicted in FIG. 1. Panel 104 also includes a second matrix 106(2) attached to back surface 110 of panel 104. That is, matrix 106(2) is also embedded into back surface 110 of panel 104, when panel 104 is formed. But as appreciated by those skilled in the art having the benefit of this disclosure, matrix 106(2) may be coupled to panel 104 by mechanical means such as glue, staples, tacks, or other coupling means.

Veneer, such as faux stones 120 (see, e.g., FIG. 1), may be fastened to panel 104 of system 400 by fastening means such as mortar, glue, adhesive, screws, nails, a combination of the foregoing, or other fastening means. In addition, stucco (in lieu of veneer), and mortar may be adhered directly to matrix 106(1).

Figure 5A:
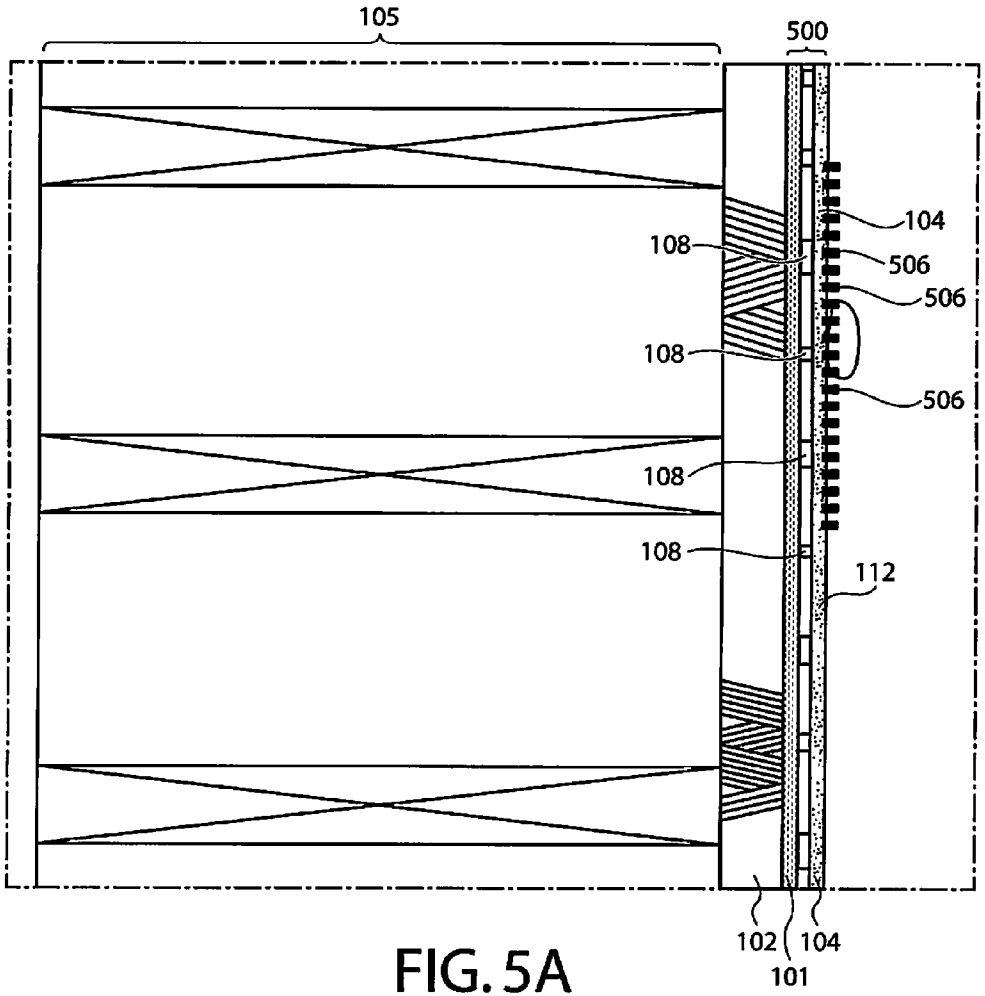
FIG. 5A is a profile view of another example of a wall-panel system for attachment to a wall of a building in accordance with this disclosure.

FIG. 5A is a profile view of another example of a wall-panel system 500 for attachment to a wall 102 of a building. System 500 includes the same panel 104, and spacers 108 as depicted in FIG. 1. However, in lieu of a hairy mesh (nylon mesh) for matrix 106, a fiberglass-wire mesh 506 is embedded into front surface 112 of panel 104. Mesh 506 may be of various thickness such as ⅛$^{th}$ or ¼ inch thick. As will be appreciated by those skilled in the art after having the benefit of this disclosure, mesh 506 may also be of different thickness, and comprised of other materials including plastic, nylon, or other suitable materials.

Veneer, such as faux stones 120, may be fastened to panel 104 of system 500 by fastening means such as mortar, glue, adhesive, screws, nails, a combination of the foregoing, or other fastening means. In addition, stucco (in lieu of veneer), and mortar may be adhered directly to mesh 506.

Figure 5B:
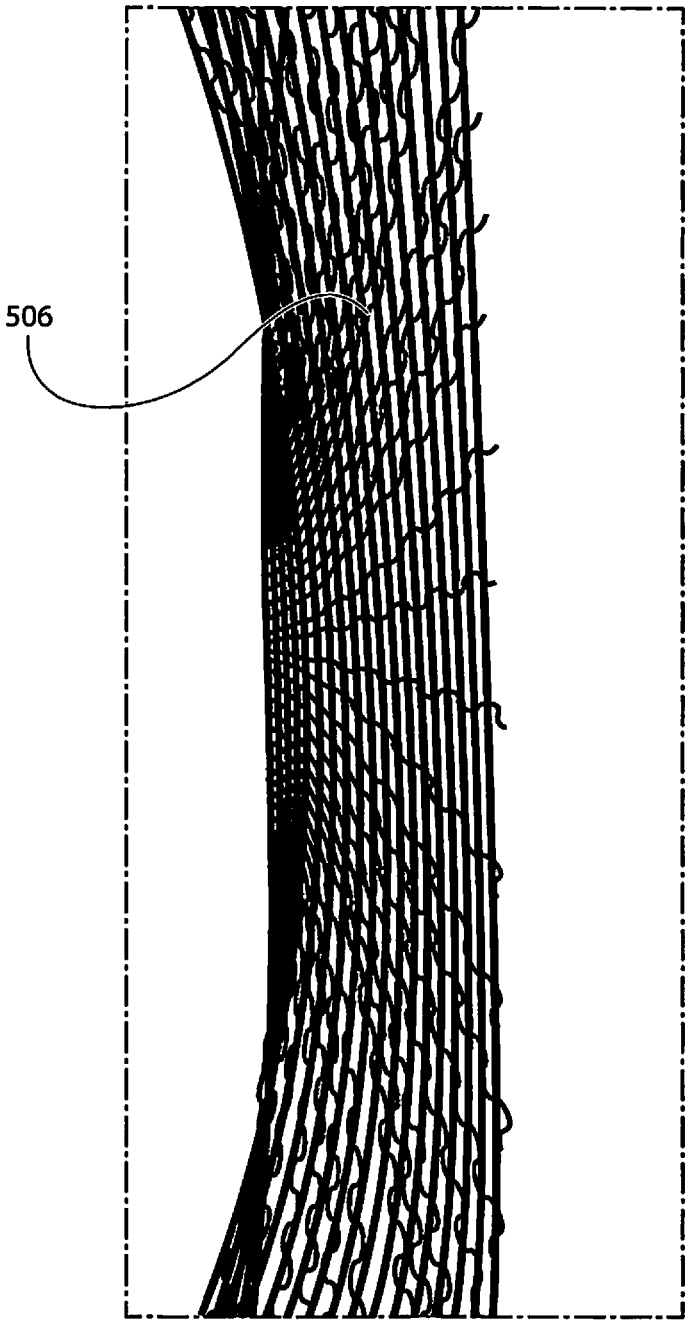
FIG. 5B is a perspective view of the wire mesh depicted in FIG. 5A.

FIG. 5B is a perspective view of the wire mesh 506 depicted in FIG. 5A.

Figure 6:
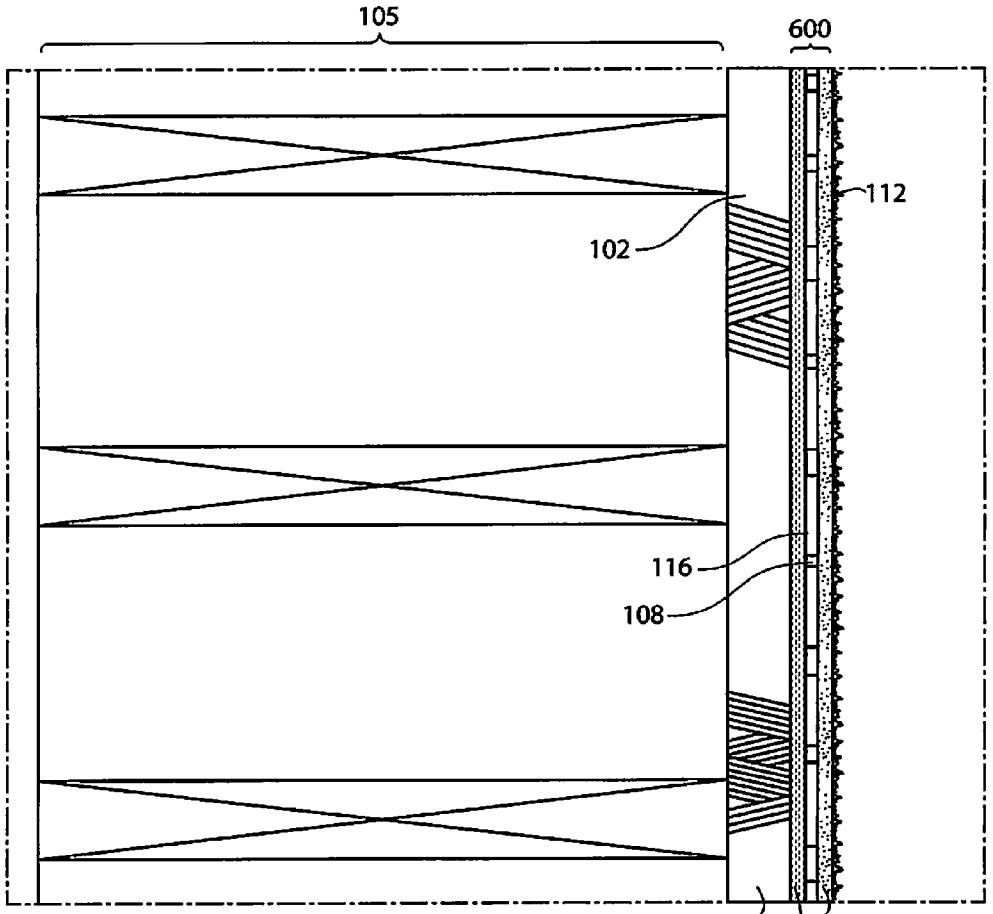
FIG. 6 is a profile view of another example of a wall-panel system for attachment to a wall 102 of a building in accordance with this disclosure.

FIG. 6 is a profile view of another example of a wall-panel system 600 for attachment to a wall 102 of a building. In this example, panel 104 includes a roughed-up front surface 112 in lieu of a matrix or mesh. That is, surface 112 includes a rough or irregular-hatched pattern that is molded into the surface 112.

Figure 7:
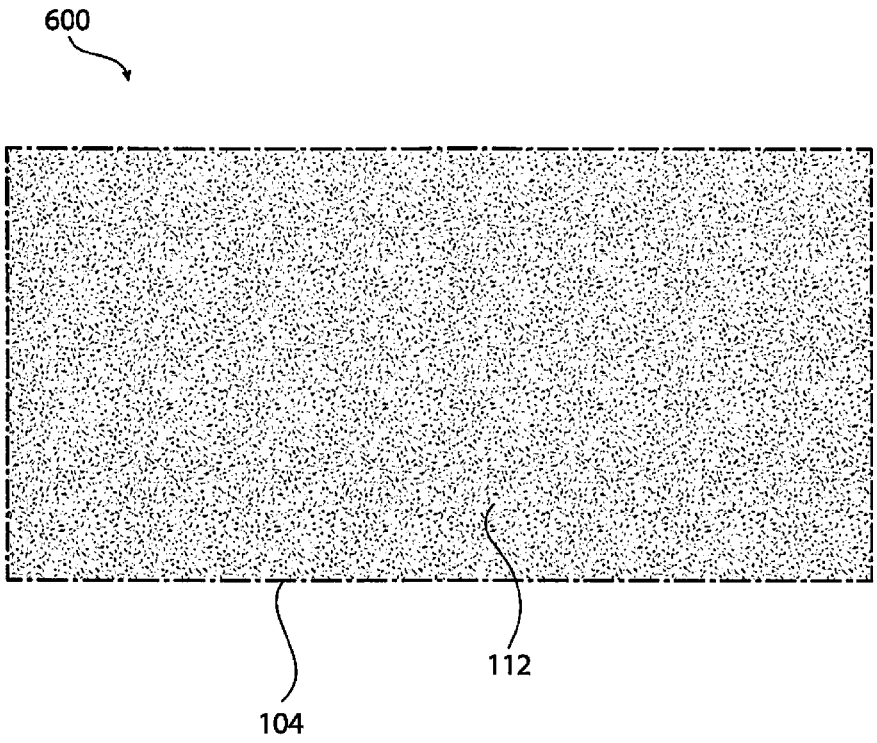
FIG. 7 shows a top view of one example of a pattern for a roughed version of a front surface of a panel for wall system in accordance with this disclosure.

FIG. 7 shows a top view of one example of a pattern for a roughed version of front surface 112 of panel 104 according to the example system 600. Veneer, such as faux stones 120 (e.g., FIG. 1), may be fastened to panel 104 of system 600 by fastening means such as mortar, glue, adhesive, screws, nails, a combination of the foregoing, or other fastening means. In addition, stucco (in lieu of veneer), and mortar may be adhered directly to surface 112.

Figure 8A:
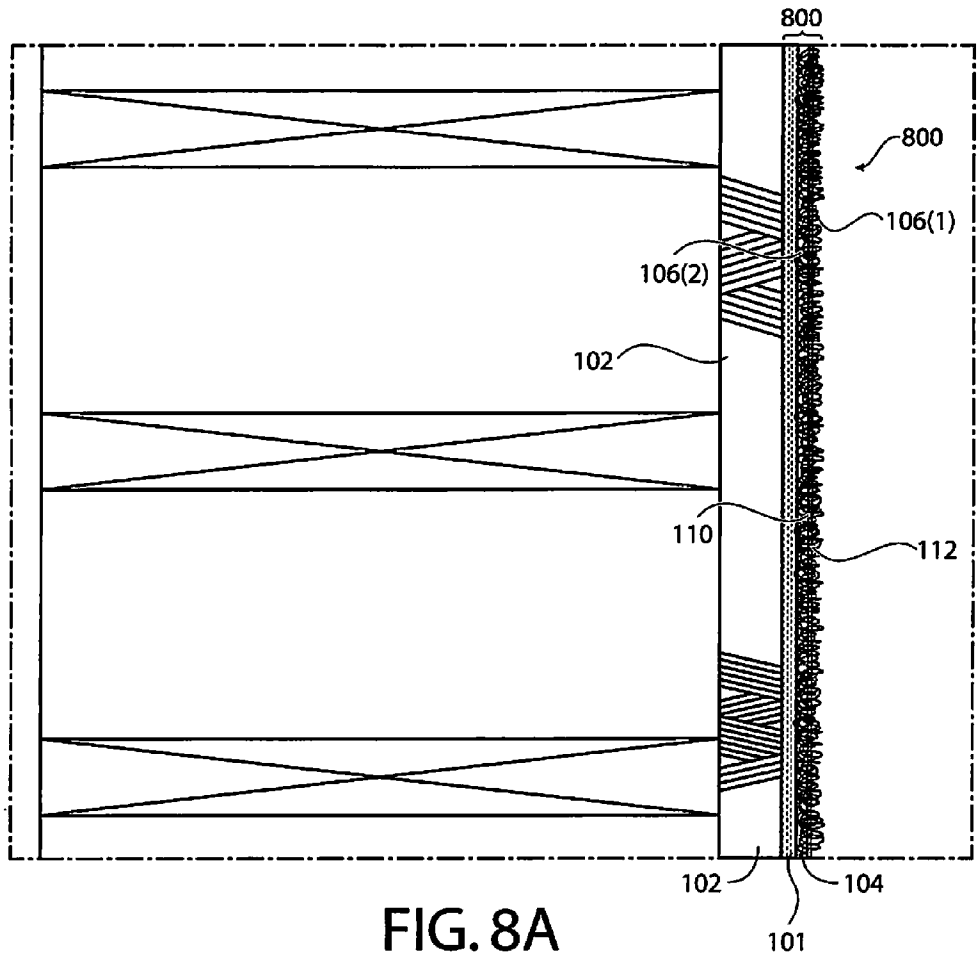
FIG. 8A is a profile view of another example of a wall-panel system for attachment to a wall of a building in accordance with this disclosure.

FIG. 8A is a profile view of another example of a wall-panel system 800 for attachment to a wall 102 of a building. In the example of FIG. 8, panel 104 is made of fabric, such as nylon or a related blend. Fabric panel 104 may be about ⅛ of an inch thick, but may have greater or less thickness as would be appreciated by those skilled in the art having the benefit of this disclosure. Here, matrix 106(1) and matrix 106(2) may be tied into, fastened, or sewn into panel 104. In this example, if matrix 106(2) is used on back surface 110 of panel 104, spacers 108 may be omitted. Veneer, such as faux stones 120, may be fastened to panel 104 of system 800 by fastening means such as mortar, glue, adhesive, screws, nails, a combination of the foregoing, or other fastening means. In addition, stucco (in lieu of veneer), and mortar may be adhered directly to matrix 106(1).

Figure 8B:
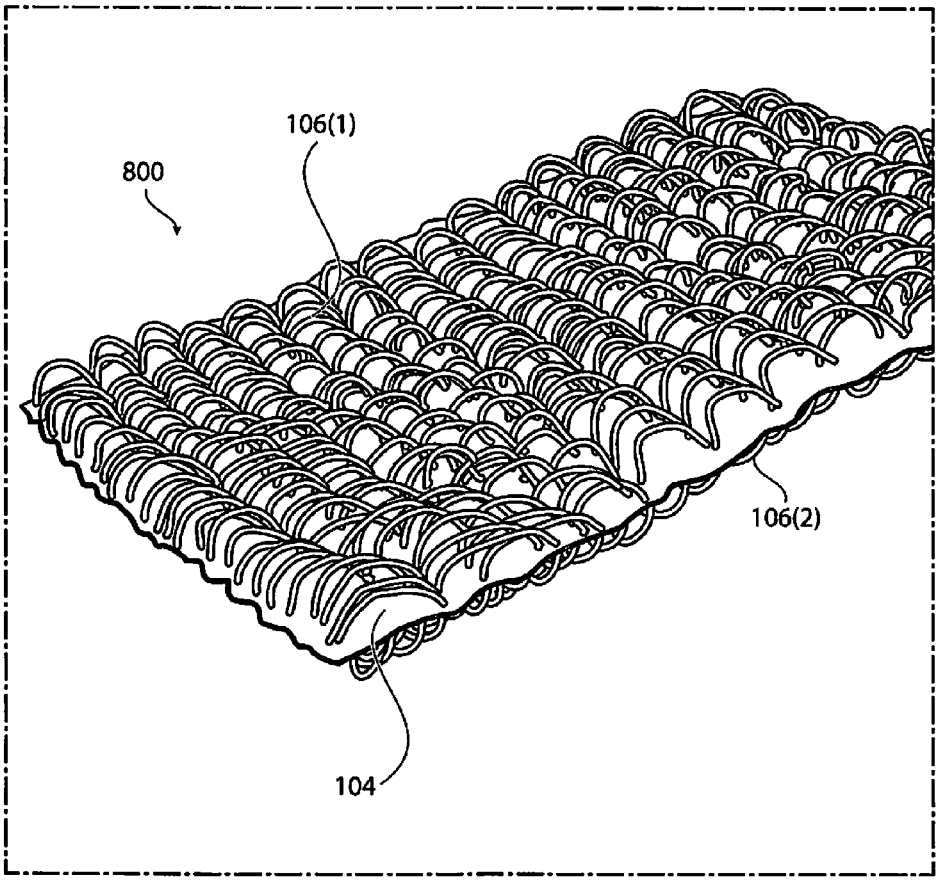
FIG. 8B shows a perspective view of the system depicted in FIG. 8A.

FIG. 8B shows a perspective view of the system depicted in FIG. 8A.

Figure 9:
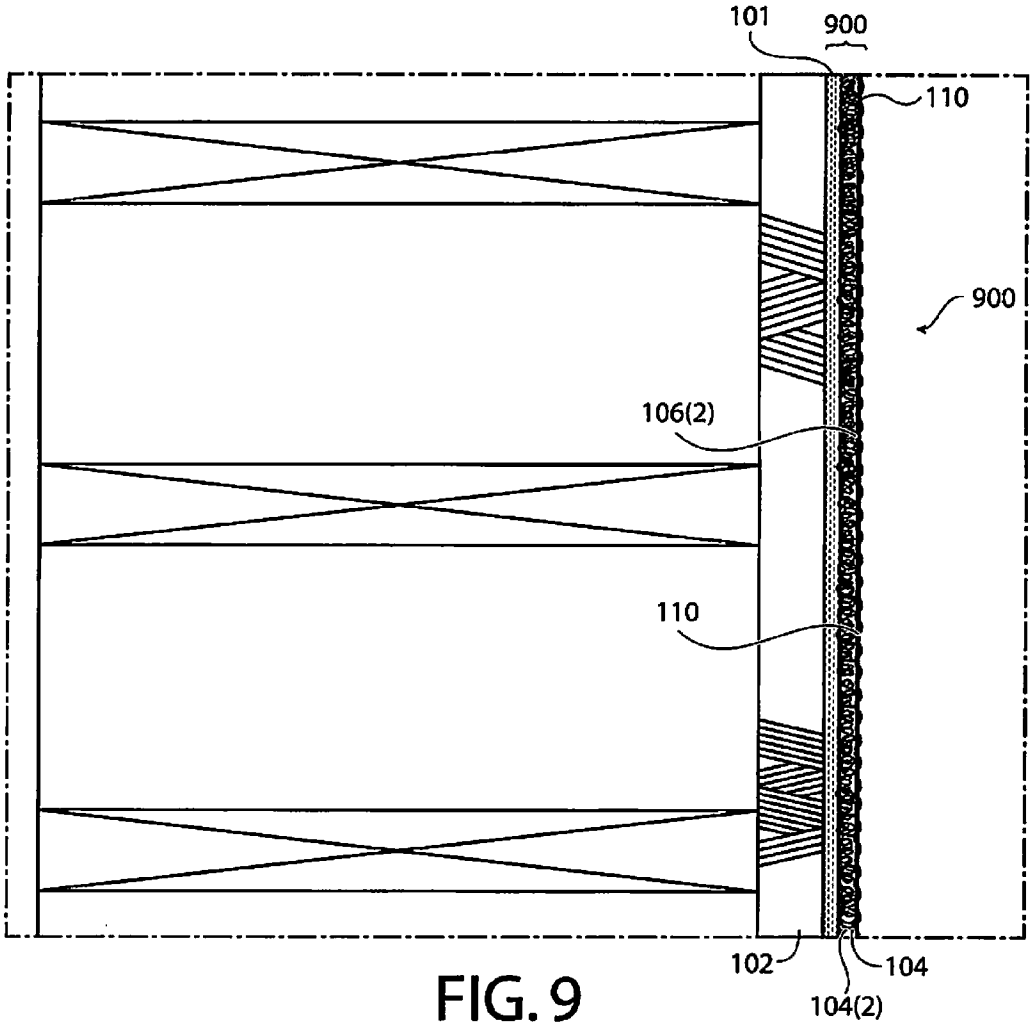
FIG. 9 is a profile view of another example of a wall-panel system for attachment to a wall of a building in accordance with this disclosure.

FIG. 9 is a profile view of another example of a wall-panel system 900 for attachment to a wall 102 of a building. In the example of FIG. 9, panel 104 is again made of a fabric like as described with reference to FIG. 8. However, only a matrix 106(2) is tied to, fastened, or sewn into back surface 110 of panel 104. Spacers 108 may be omitted or included.

Figure 10:
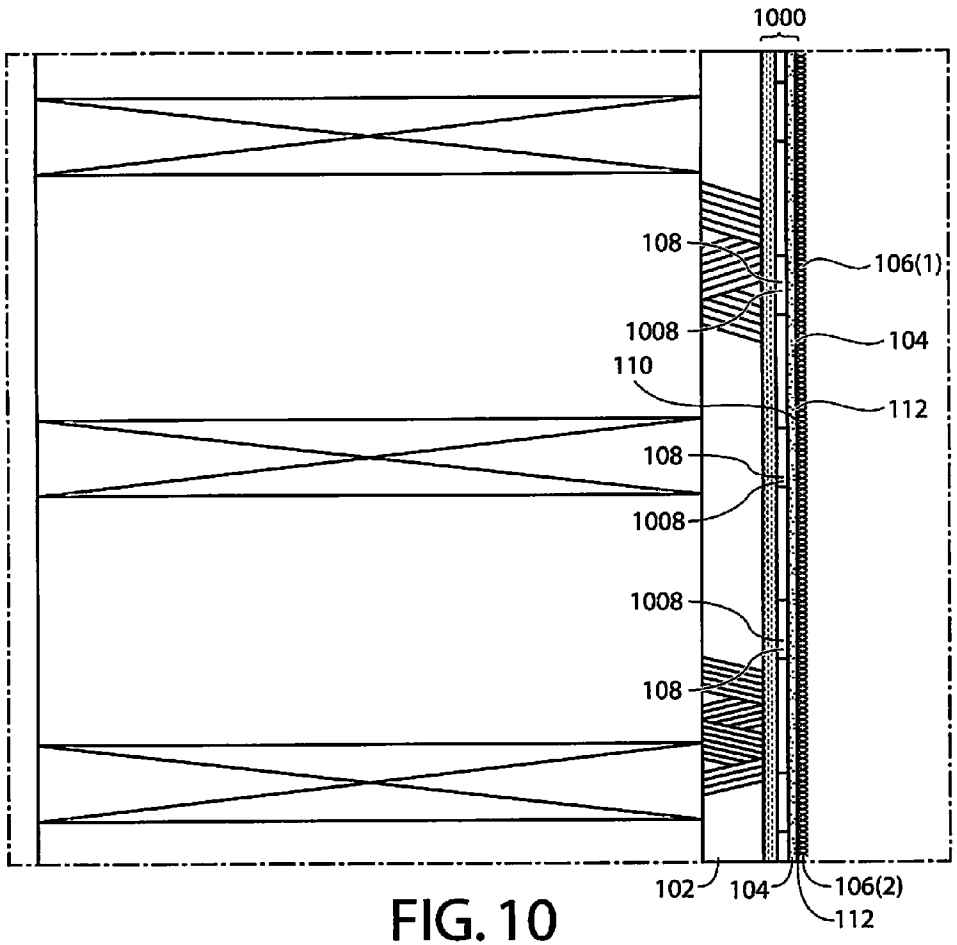
FIG. 10 is a profile view of another example of a wall-panel system for attachment to a wall of a building in accordance with this disclosure.

FIG. 10 is a profile view of another example of a wall-panel system 1000 for attachment to wall 102 of a building. In the example of FIG. 10, panel 104 is again made of a fabric as describe above. A matrix 106(1) is attached to front surface 112 of fabric panel 104 by adhesive, a mechanical fastener, or a combination of attachment means. On back surface 110 of panel 104, spacers 108 in the form of buttons 1008 are fastened to panel 104. Buttons 1008 protrude from back surface 110, and form channels for drainage of water. Buttons 1008 may also serve as a location for mechanically securing panel 104 to a wall of a structure, such as a building. In one example, buttons 1008 are plastic. Buttons 1008 may also be comprised of other materials, such as fiber glass, polymer, rubber, a composite, or various other related materials or combinations thereof. Buttons 1008 may be glued, sewn, or attached by any suitable fastening mechanism. Buttons 1008 may also be of various sizes and thickness, such as 1 inch in diameter, and ⅛ inch thick. In addition, the panel may be fastened to wall 102 by inserting nails or screws (or other fastening means) through buttons 1008, which act as spacers 108.

Figure 11:
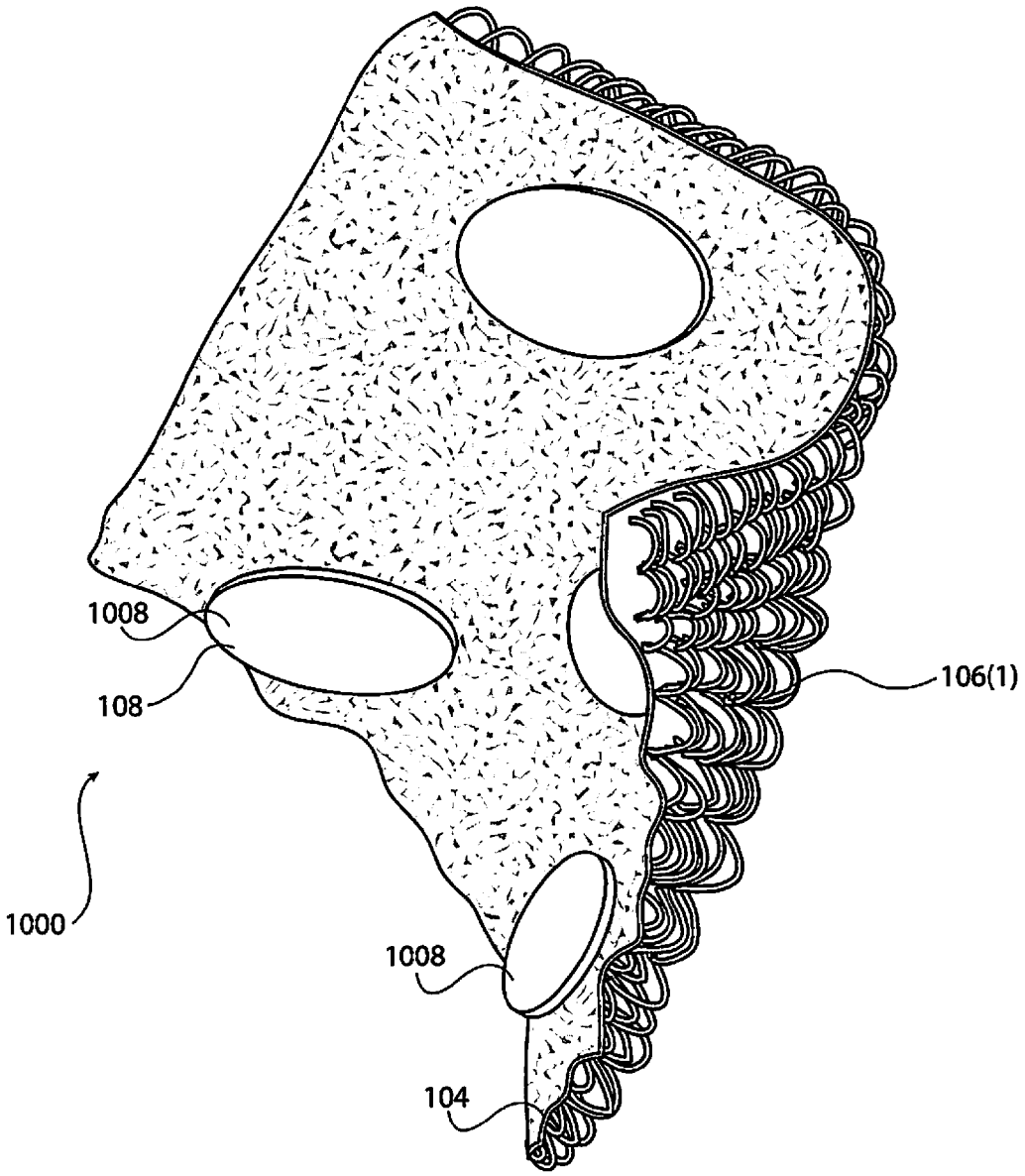
FIG. 11 is a perspective view of the system depicted in FIG. 10.

FIG. 11 is a perspective view of example system 1000 depicted in FIG. 10. Buttons 1008, matrix 106(1), and panel 104 are also depicted in this view.

Figure 12:
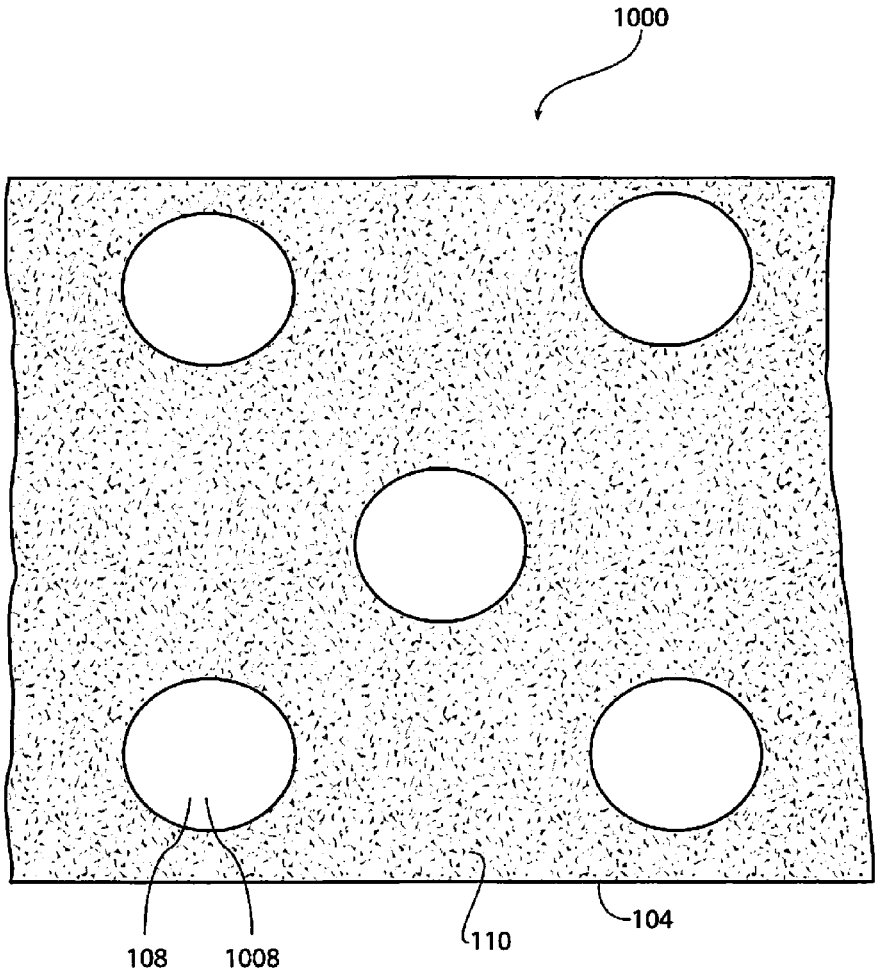
FIG. 12 is a top view of another example system illustrating a back surface of a panel of the system with buttons attached thereto in accordance with this disclosure.

FIG. 12 is a top view of example 1000 showing back surface 110 of panel 104 with buttons attached thereto. The shapes, patterns, spacing, and density of buttons 1008 used may vary depending on the application, and environment in which the veneer is being installed.

Figure 13:
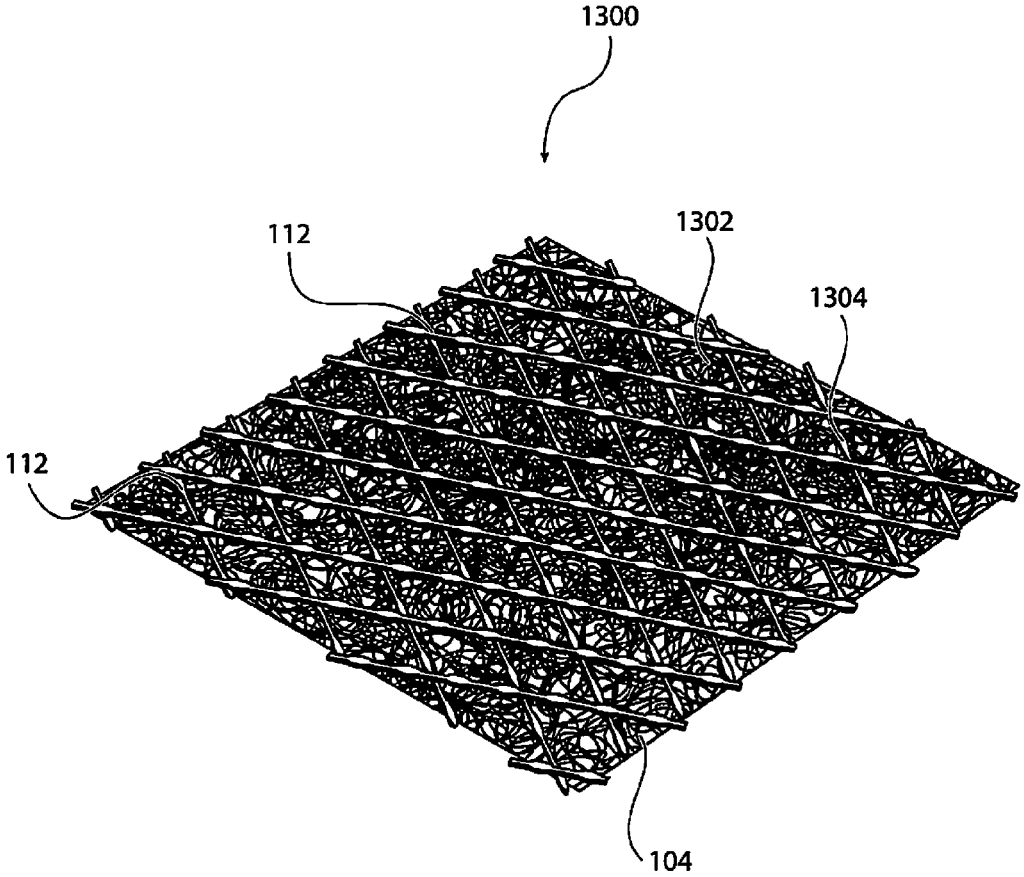
FIG. 13 is a top view of another example of a system having a fabric panel in accordance with this disclosure.

FIG. 13 is a top-perspective view of another example system 1300 having a fabric panel 104. In the example FIG. 13, front surface 112 of panel 104 includes a predetermined pattern of diamond-shaped pockets 1302. Edges 1304 outline each pocket 1302 are approximately a ¼ of an inch above front surface 112 of panel 104.

Figure 14:
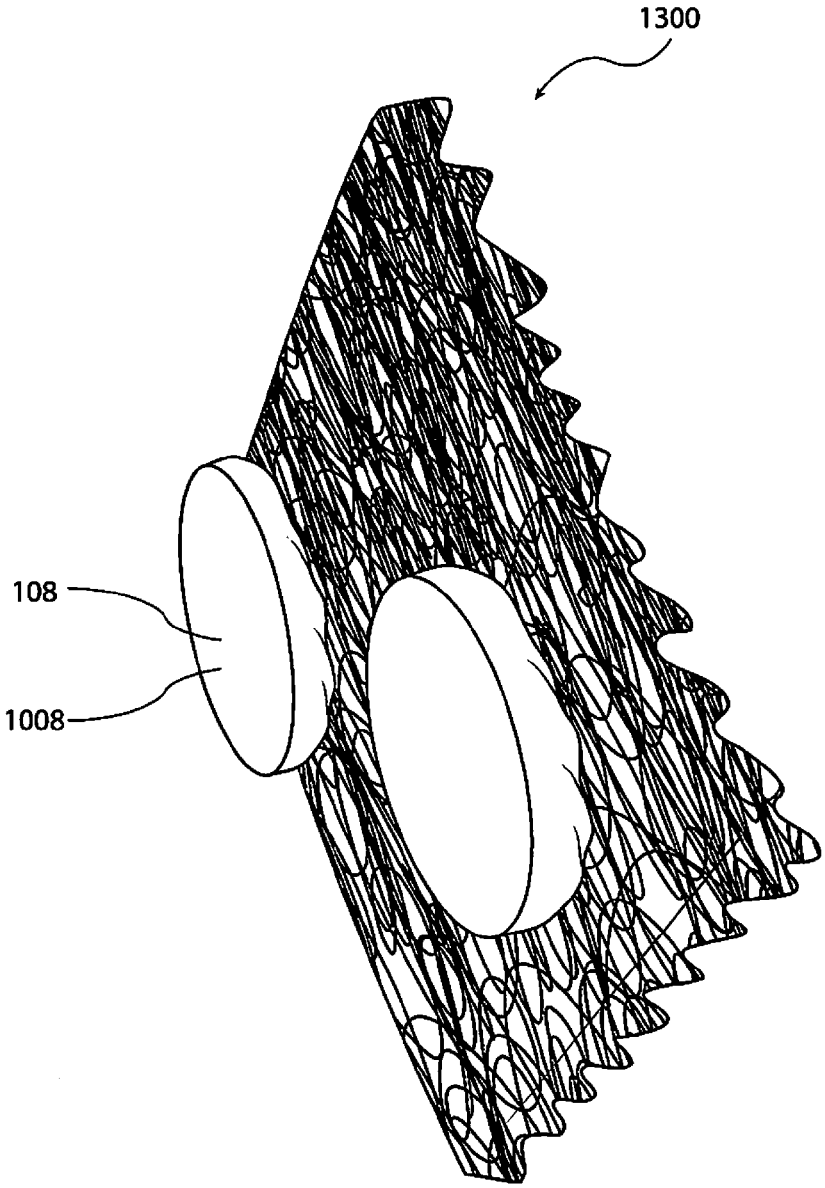
FIG. 14 shows a side view of the system depicted in FIG. 13 with spacers in the form of buttons as depicted in FIGS. 11 and 12.
Figure 15:
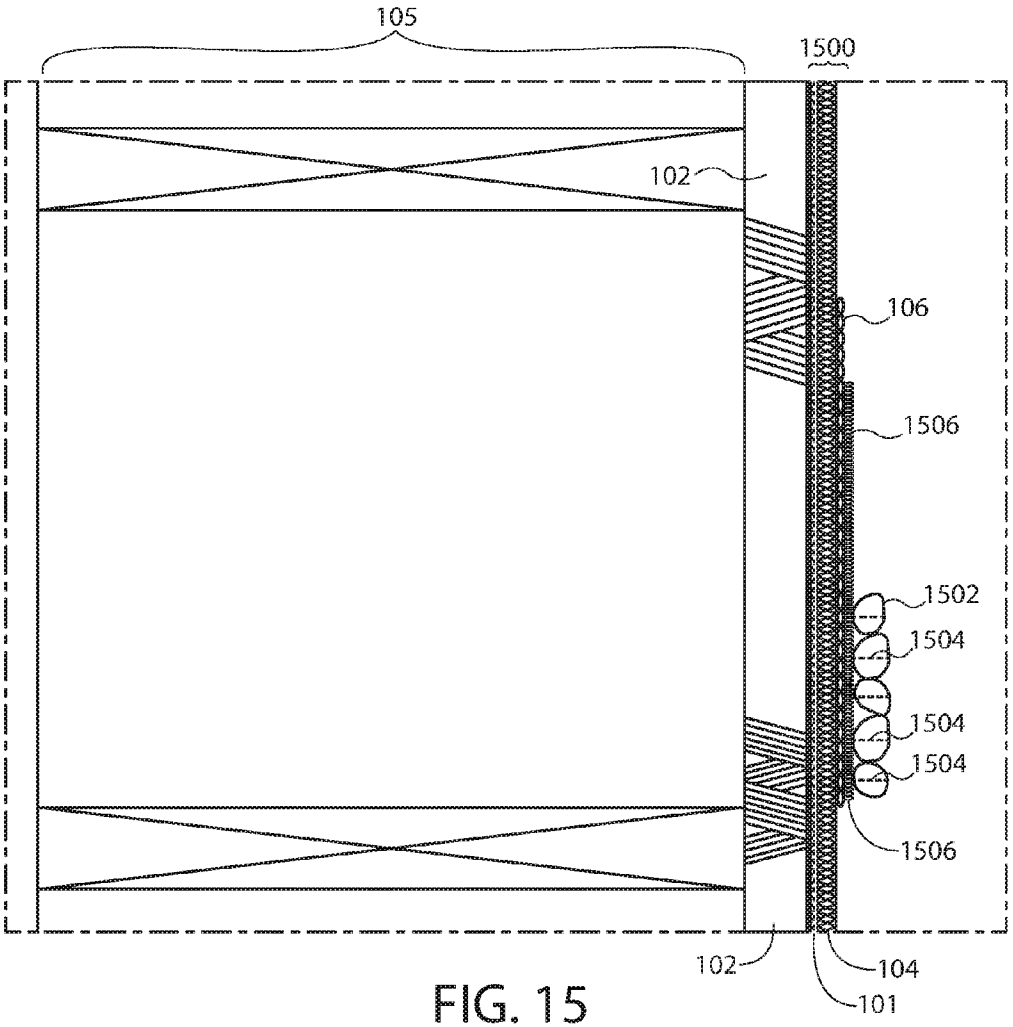
FIG. 15 shows an example system for attaching faux stone to a wall in accordance with this disclosure.

FIG. 14 shows a side view of system 1300 with spacers 108 in the form of buttons 1008 as depicted in FIGS. 11 and 12. As appreciated by those skilled in the art after having the benefit of this disclosures, buttons 1008 may also be other types of spacers 108 fastened to panel 104. For instance, spacers 108 may be of any suitable dimension, and shape. And may include any water impervious or waterproof material, such as in the form of a grommet, washer, bushing, strip, band, ring, and other suitable configurations as would be appreciated by those skilled in the art with the benefit of this disclosure FIG. 15 shows an example system 1500 for attaching faux stone 1502 to a wall. System 1500 may include any of the example systems described above such as systems 100 through 1300. As used herein, "faux stone" refers to manufactured stone, bricks, or other faux veneer. For instance, in one example, the faux stone is made in accordance with materials (or similar or equivalent materials) described in U.S. Pat. Nos. 7,959,991 and 7,198,833 to West, which are hereby incorporated by reference as if fully set forth in this disclosure. In another example, the faux stone is manufactured by Evolve Stone, LLC, and is generally resilient allowing nails to be driven into the stone without chipping or flaking. The stone is also light. For instance, an Evolve Stone LLC's faux stone that is 12 inches×12 inches in height and width, and 1 inch thick weighs about 2.7 lbs. Of course, heavier faux veneer may be used.

Referring to FIG. 15, each stone 1502 is simply fastened directly through a panel 104 comprising system 1500, and into wall 102. That is, a fastener 1504, such as a nail, pin, screw, stud or similar fasteners may be driven through each stone 1502, and into wall 102. Fastener 1504 may also be driven through each stone 1502, and into panel 104 and not directly to wall 102.

In addition, a bonding material 1506, such as cement, mortar and/or glue, may be applied to matrix 106 of system 1500 before each stone 1502 is attached. Next, each stone 1502 may be fastened to wall 102 using a fastener 1504, thereby holding the stone 1502 in place while bonding material 1506 cures. The fastener 1504 may remain in place after curing, for additional strength. If the fastener 1504 is thin enough, and of similar colors to stone, it cannot generally be seen by a casual observer. For instance, if stainless steel-pin nails are used (slightly countersunk into each stone 1502) then a casual observer should not perceive that the stones are secured to a wall by nails.

Figure 16:
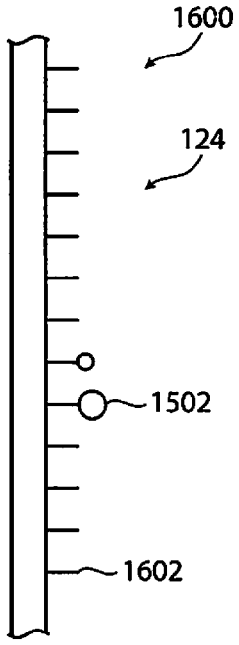
FIG. 16 shows another example system for attaching faux stone to a wall in accordance with this disclosure.
Figure 17A:
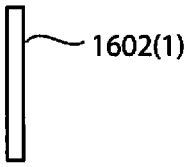
FIGS. 17A, 17B, 17C, 17D, and 17E show profile views of example pins used to secure faux stones thereon.
Figure 17B:
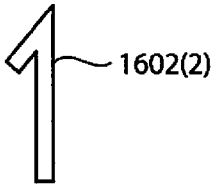
Figure 17C:
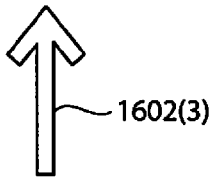
Figure 17D:
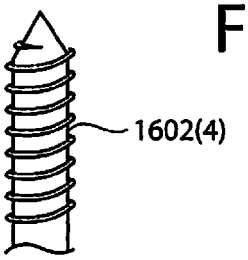
Figure 17E:
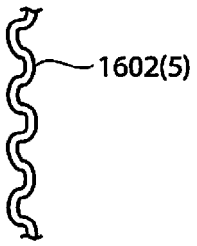

FIG. 16 shows another example system 1600 for attaching faux stone 1502 (FIG. 15) to a wall 102. Here, pins 1602 may extend from panel 104 (such as a fiberglass panel shown in FIG. 1). Pins 1602 may be made of one or more different materials such as wood, stainless steel, plastic, and fiberglass. The length of pins 1602 may be of a suitable length to receive securely affix stone 1502 to one or more pins by applying pressure to the opposite side 1604 of stone 1502. That is, an installer will apply force (push or hammer) stone 1502 toward wall 102, thereby impaling (or embedding) an exposed length of pins 1602 into stone 1502. It is usually desirable have a pin length that does not exceed the thickness of stone 1502. In one example, pins 1602 are between ⅛ of an inch to 1 inch long. Gauge or thickness of pins 1602 may vary between 10 and 20. The lengths of pins 1602 (and widths) may also be staggered, with shorter and longer pins dispersed throughout front face 124 system 1600. Of course, as appreciated by those skilled in the art after having the benefit of this disclosure, other suitable pin lengths and widths may be selected depending on the size of stones 1502. In addition, pins may be spaced apart every ¼ or ½ inch or greater (or lesser) from each other along front face 124 of system 1600.

FIGS. 17A-E show profile views of example pins 1602 (1), 1602(2), 1602(3), 1602(4), and 1602(5), respectively, used to skewer and secure stones thereon. Pin 1602(1) (FIG. 17A) is a straight pin. Each pin 1602 is generally perpendicular to wall 102, and parallel to the ground. Pin 1602(2) (FIG. 17B) includes a single barb at the distal end of the pin. Pin 1602(3) (FIG. 17C) includes a double-bar at the distal end of the pin. Pin 1602(4) (FIG. 17D) includes a screw/thread pattern. Pin 1602(5) (FIG. 17E) includes a squiggly pattern. Pins 1602(2) through 1602(5) generally have a greater ability to lock each stone onto wall 102 than pin 1602(1). Pins 1602 are illustrative fasteners, and are limited as to the shape and form of the possible fasteners that may be used to attach stones thereto.

In addition, pins 1602 may have pre-adhesive materials applied to them before each stone 104 is affixed thereto. After each stone 1502 is slid onto one or more pins 1602, the stones become affixed thereto, pins 1602 are hidden from view. Because each stone is securely attached individually, and held in place by pins 1602 and possibly glue and mortar too, stones 1502 should not fall or become dislodged from wall 102, even if mortar or glue becomes ineffective over time.

Figure 18:
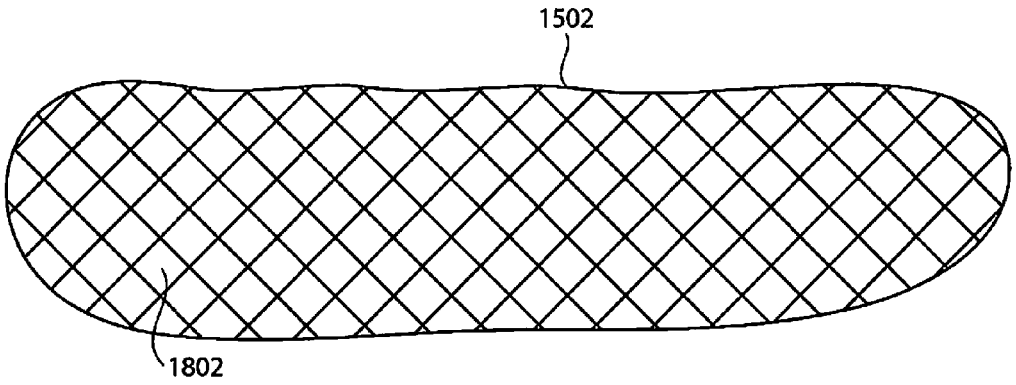
FIG. 18 shows a top view of a faux stone manufactured in accordance with this disclosure.

FIG. 18 shows a top view of a faux stone 1502 manufactured in accordance with this disclosure. As depicted in FIG. 18, stone 1502 includes an abrasive side 1802 that is generally planar for better mechanical attachment to systems 100 through 1600, and the better mechanical attachment of glue or mortar. The mortar may have plasticizers, or other modifiers added thereto as appreciated by those skilled in the art.

Figure 19:
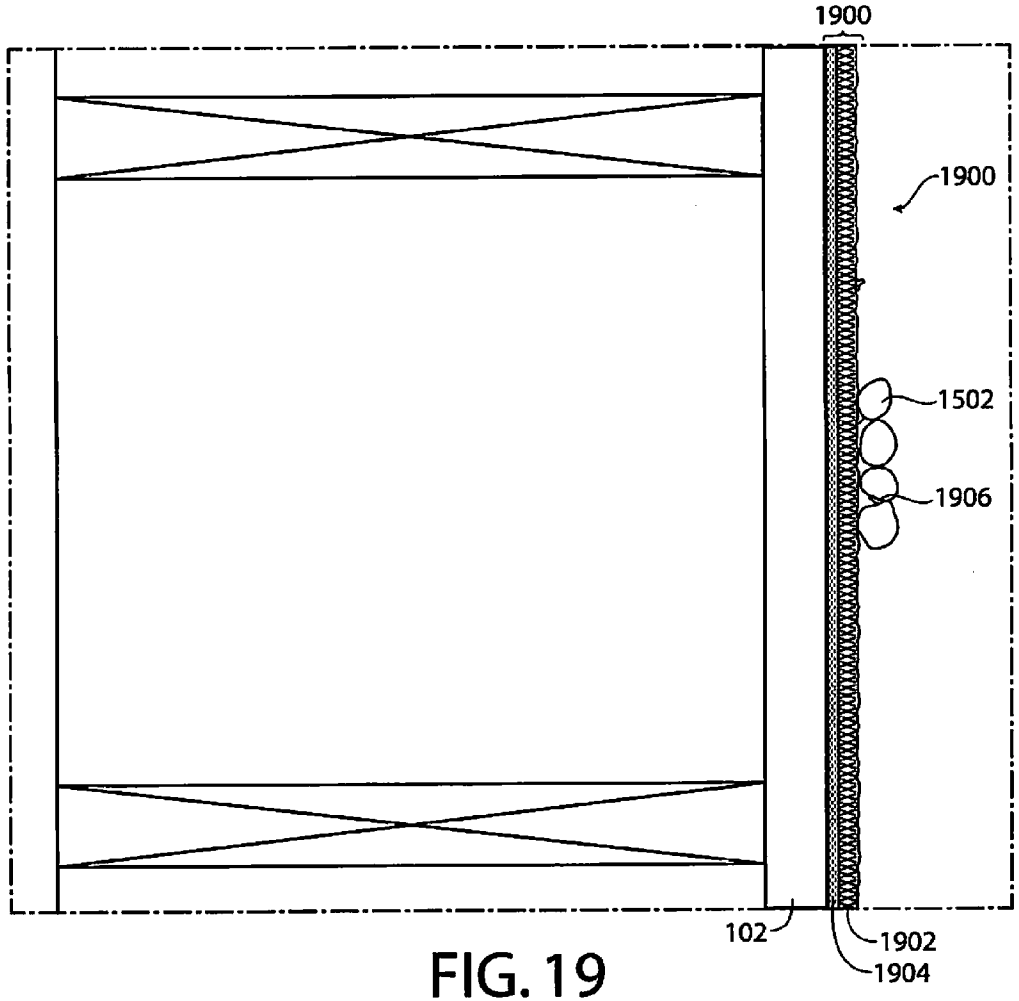
FIGS. 19-20 show profile views of other example systems for attaching faux stone to a wall.

FIG. 19 shows a profile view of another example system 1900 for attaching faux stone 1502 to a wall. System 1900 includes a wire lath 1902 used with conventional brick and stucco. A felt 1904 (such as 15 lb. and 30 lb) may be used in between lath 1902 and wall 102. CDX, plywood OSB or other exterior materials may also be used as an intermediary between wall 102, and lath 1902. Fasteners 1906 may be used to hold each stone 1502 in lieu of pins. Example fasteners 1906 include any suitable mechanical tie back including brick-tie backs. Mortar may be applied directly to lath 1902.

Figure 20:
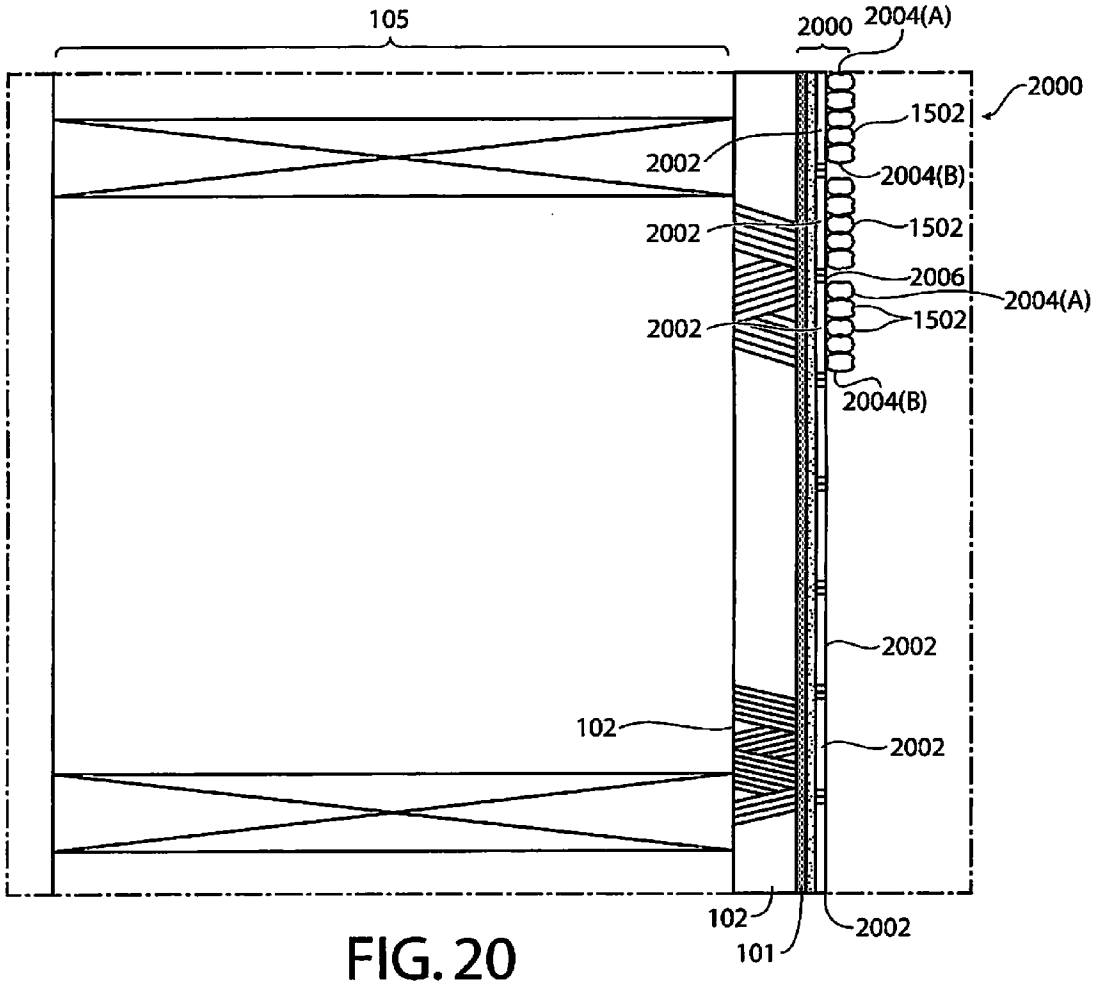

FIG. 20 shows a profile view of another example system 2000 for attaching faux stone 1502 to a wall 102. Here modular panels 2002 containing pre-attached faux stone 1502 are attached to wall 102. Panels 2002 may be used in combination with systems 100, 400, 500, 600, 8000, 900, 1000, and 1300 described above. Panels 2002 may also incorporate any of the features described with reference to these systems, or other suitable features as would be appreciated by one skilled in the art after having the benefit of this disclosure. Each panel 2002 may be of any suitable size. For instance, panels may be one foot by one foot, or 4'×8', 8'×16', or other suitable dimensions greater or smaller than the aforementioned sizes.

Figure 21:
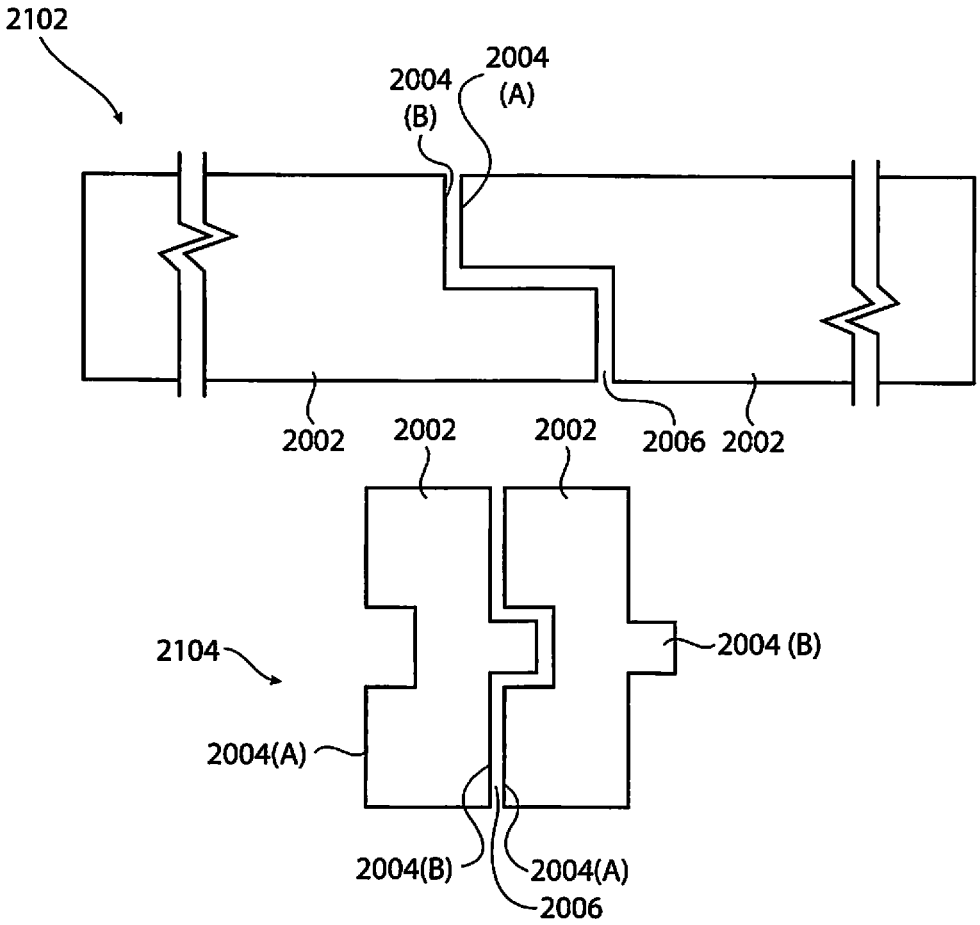
FIG. 21 shows two example configurations for interconnecting panels.

At distal edges 2004(A), 2004(B) of each panel 2002 there may be a mechanical interconnect system 2006 to fasten panels 2002 to each other. For instance, FIG. 21 shows two example interlocking shape systems 2102 and 2104 for interconnecting panels 2002. Other suitable shapes and interlocking shape system may be used including Lego® style interlocking systems, peg and hole systems, and other suitable systems as would be appreciate by one skilled in the art after having the benefit of this disclosure. In addition, panels 2002 may have flanges at each distal end or not. And flanges may be non-interlocking configurations.

Figure 22:
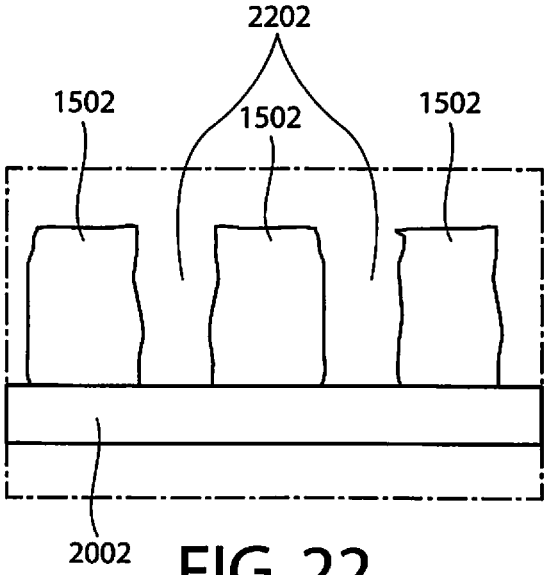
FIG. 22 shows a profile-focused view of a panel with faux stone pre-attached thereto.

FIG. 22 shows a profile-focused view 2200 of a panel 2002 with faux stone 1502 pre-attached thereto. As shown, gaps 2202 may be included between stone to permit mortar to be placed between gaps 2202 to permit a builder to customize the cosmetic look and feel of the mortar, such the color therefor. Of course, mortar may or may not come pre-installed as part of panel 2002. Furthermore, each stone 1502 may be plugged into a panel via pins (as described earlier) or other fastening means. This permits customization of stone look, and allows an installer to break up of shapes and patterns of faux stone, and enhance/customize the cosmetic appearance of each panel.

Exemplary embodiments have been disclosed herein, and although specific terms are employed, they are used and are to be interpreted in a generic and descriptive sense only and not for purpose of limitation. For example, it will be understood that when a layer is referred to as being "on" another layer or substrate, it can be directly on the other layer or substrate, or intervening layers may also be present.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. A method for making a separation system for installation between veneer and a wall of a building, comprising:

providing a structural-separation-plane panel, wherein the panel is substantially flat and planar, and includes a back surface and a front surface;

providing a first matrix of substantially-tangled-hairy mesh having substantially flexible interwoven strands directly affixed to and substantially coextensive with the front surface of the panel such that the first matrix is partially embedded in the front surface of the panel, wherein the first matrix is substantially permeable to both air and water; and providing a second matrix of substantially-tangled-hairy mesh having substantially flexible interwoven strands directly affixed to and substantially coextensive with the back surface of the panel such that the second matrix is partially embedded in the back surface of the panel, wherein the second matrix is substantially permeable to both air and water, and wherein the structural-separation-plane panel is sandwiched between the first and second matrix.

2. The method of claim 1, wherein the panel is substantially rigid and water impervious.

3. The method of claim 1, wherein the panel is fiberglass.

4. The method of claim 1, further comprising providing a thickness of the panel ranging between about 1/16 of an inch and about one inch measured from the back surface to the front surface.

5. The method of claim 1, further comprising extending a length of the first matrix from the front surface of the panel ranging between about 3/16 of an inch and about one inch.

6. The method of claim 1, wherein the first and second matrix are a nylon mesh.

7. The method of claim 1, wherein the panel is a substantially flexible fabric material and water impervious.

8. A method of installing manufactured stone to a wall, comprising:

providing a wall-panel system comprising (i) a water-drainage plane, and (ii) a structural-separation-plane panel, wherein the panel is substantially flat and planar, and includes a back surface, a front surface, and at least one of (A) a first matrix of substantially-tangled-hairy mesh having substantially flexible interwoven strands directly affixed to and substantially coextensive with the front surface of the panel such that the first matrix is partially embedded in the front surface of the panel, wherein the first matrix is substantially permeable to both air and water and (B) a second matrix of substantially-tangled-hairy mesh having substantially flexible interwoven strands directly affixed to and substantially coextensive with the back surface of the panel such that the second matrix is partially embedded in the back surface of the panel, wherein the second matrix is substantially permeable to both air and water;

connecting the wall-panel system to an exterior portion of the wall such that the water-drainage plane is sandwiched between the wall and the structural-separation-plane panel; and fastening faux stone to at least the front surface of the structural-separation-plane panel including inserting one or more fasteners completely through a central body region of the faux stone, and into the panel thereby securing the faux stone onto the panel connected to the wall.

9. The method of claim 8, further comprising the step of applying bonding material to the front surface of the structural-separation-plane panel, whereby the faux stone is secured by the one or more fasteners onto the panel at least one of (a) before the bonding material is applied and (b) while and after the bonding material cures.

10. The method of claim 8, wherein both the first matrix and the second matrix are directly affixed to the structural-separation-plane panel such that the panel is sandwiched between the first and second matrix.

11. The method of claim 8, wherein the wall-panel system further comprises spacers that protrude from the back surface of the panel; wherein the spacers extend from the back surface of the panel and form the water-drainage plane.

12. The method of claim 8, wherein a width of the water-drainage plane is between about 1/16 of an inch and about 3 inches.

* * * * *